US007281295B2

(12) United States Patent
Mattingly et al.

(10) Patent No.: US 7,281,295 B2
(45) Date of Patent: Oct. 16, 2007

(54) CANISTER VACUUM CLEANER WITH STAIR HUGGING SWIVEL WHEEL ASSEMBLY

(75) Inventors: Leon A. Mattingly, Danville, KY (US); James T. Crouch, Danville, KY (US)

(73) Assignee: Fanasonic Corporation of North America, Seacaucua, NJ (US)

( * ) Notice: Subject to any disclaimer, the term of this patent is extended or adjusted under 35 U.S.C. 154(b) by 519 days.

(21) Appl. No.: 10/876,151

(22) Filed: Jun. 24, 2004

(65) Prior Publication Data

US 2005/0015917 A1 Jan. 27, 2005

Related U.S. Application Data

(60) Provisional application No. 60/489,878, filed on Jul. 24, 2003.

(51) Int. Cl.
*A47L 9/00* (2006.01)

(52) U.S. Cl. ..... 15/339; 15/327.7

(58) Field of Classification Search ..... 15/327.2, 15/327.1, 327.7, 339; 16/35 R
See application file for complete search history.

(56) References Cited

U.S. PATENT DOCUMENTS 2,088,236 A * 7/1937 Faber ..... 15/327.2
2,248,585 A 7/1941 Ross et al.
3,015,123 A 1/1962 Descarries
3,104,112 A 9/1963 Crail
3,731,465 A 5/1973 Ohira et al.
3,820,808 A 6/1974 Brunning et al.
3,881,535 A 5/1975 Du Bois et al.
4,037,291 A * 7/1977 Huempfner et al. ..... 16/35 R
4,509,227 A 4/1985 Keane
4,592,764 A 6/1986 Ikezaki et al.
4,945,603 A 8/1990 Herron, Jr.
5,371,922 A * 12/1994 Chern et al. ..... 16/35 R
5,720,076 A * 2/1998 Clark ..... 15/339
5,937,477 A 8/1999 Dyson
6,928,690 B2 * 8/2005 Ji ..... 15/339
6,961,976 B2 * 11/2005 Kuo ..... 16/35 R
7,146,680 B2 * 12/2006 Kim ..... 15/339

FOREIGN PATENT DOCUMENTS

GB 2297243 7/1996

* cited by examiner

*Primary Examiner*—Theresa T. Snider
(74) *Attorney, Agent, or Firm*—King & Schickli, PLLC

(57) ABSTRACT

A canister vacuum cleaner has a canister assembly and a stair hugging swivel wheel assembly. The stair hugging swivel wheel assembly pivotally connects to the canister assembly and has both a pendulum and a wheel rotatably mounted to a housing thereof. During use, the pendulum projects from the housing under the influence of gravity to inhibit or otherwise prevent the stair hugging swivel wheel assembly from pivoting whenever the canister assembly becomes oriented in an inclined position, such as when placed on a stairway. Preferably, the pendulum mates with a recess in the canister assembly co-located with a circular track in which the stair hugging swivel wheel assembly pivots.

20 Claims, 4 Drawing Sheets

CANISTER VACUUM CLEANER WITH STAIR HUGGING SWIVEL WHEEL ASSEMBLY

This application claims the benefit of U.S. Provisional Patent Application Ser. No. 60/489,878 filed on Jul. 24, 2003.

TECHNICAL FIELD

The present invention relates generally to the floor care equipment field and, more particularly, to a canister vacuum cleaner equipped with an assembly that stabilizes the canister vacuum cleaner on a stairway.

BACKGROUND OF THE INVENTION

Tank type or canister vacuum cleaners have long been known in the art. Such vacuum cleaners typically comprise a canister assembly housing both a suction generator and a dirt collection vessel. Typically the canister assembly includes wheels or rollers which function to allow the operator to smoothly pull the canister assembly across a floor while cleaning. A cleaning wand and cooperating flexible hose are attached to the canister assembly for sucking up dirt and dust.

Since the hose typically has a fixed length, when a canister vacuum cleaner is utilized to clean stairways, the canister assembly must be either supported on a stair or held by the operator. Unfortunately, most canister vacuum cleaners cannot be stabily supported on a stair due to their size and shape as well as the presence of the movable wheels or rollers that serve to move the vacuum cleaner across a floor during use. Further, it is inconvenient and awkward for the operator to hold the canister assembly during a stair cleaning operation as this leaves only one hand to manipulate the wand.

As such, some efforts have been made in the past to address this difficulty. For example, U.S. Pat. No. 3,881,535 to Du Bois et al. discloses a canister vacuum cleaner incorporating a pair of pawls, each including a sloping cam surface at the outer end thereof to engage in cavities in the rear wheels of the vacuum cleaner. The pawls prevent rotation of those wheels and help stabilize the vacuum cleaner on a stairway as best illustrated in FIG. 1 of that patent.

U.S. Pat. No. 3,820,808 to Brunning et al. discloses a canister vacuum cleaner equipped with a lock crank including caps of resilient material that engage the rear tires or wheels of the canister assembly to hold the canister assembly on a stairway. Neither Brunning et al. or Du Bois et al., however, teach the stabilizing of forward caster wheels that have both pivoting and rotational motion. As such, both cleaners tend to shift near their front side when in an inclined position.

U.S. Pat. No. 5,937,477 to Dyson discloses a canister vacuum cleaner sized and shaped so that the canister assembly may be positioned stabily on a flight of stairs. Many consumers, however, could find the unusual shape of this device objectionable.

Accordingly, a need exists in the art for a novel, more effective and efficient way to stabilize a canister assembly on a stairway, while still maintaining a traditional appearance, so that both hands of the operator are free to complete the cleaning operation. In addition, a further need exists for effectively stabilizing caster wheels having both pivoting and rotational motion.

SUMMARY OF THE INVENTION

In accordance with the purposes of the present invention as described herein, a canister vacuum cleaner of improved design is provided. In one embodiment, a canister vacuum cleaner has a canister assembly and a stair hugging swivel wheel assembly. The stair hugging swivel wheel assembly pivotally connects to the canister assembly and has both a pendulum and a wheel rotatably mounted to a housing thereof. During use, the pendulum projects from the housing under the influence of gravity to inhibit or otherwise prevent the stair hugging swivel wheel assembly from pivoting whenever the canister assembly becomes oriented in an inclined position, such as when placed on a stairway. Preferably, the inclined position ranges from about 2° to about 90° or more from a horizontal, normal operating position. In addition, the pendulum mates with a recess of the canister assembly co-located with a circular track in which the stair hugging swivel wheel assembly pivots. Alternatively, the stair hugging swivel wheel assembly locates the recess while the canister assembly locates the pendulum.

In other embodiments, the pendulum embodies a truncated cylinder shaped apparatus having projections on either sides thereof that mate by insertion into corresponding holes on the housing of the stair hugging swivel wheel assembly. The stair hugging swivel wheel assembly may additionally include a stair engaging face to which the pendulum projects in a direction opposite this face when swung into the recess of the canister assembly.

In still other embodiments, the pendulum and wheel of the stair hugging swivel wheel assembly may attach directly to the canister assembly.

BRIEF DESCRIPTION OF THE DRAWING FIGURES

The accompanying drawings incorporated in and forming a part of the specification, illustrate several aspects of the present invention, and together with the description serve to explain certain principles of the invention. In the drawings.

Reference will now be made in detail to the present preferred embodiments of the invention, examples of which are illustrated in the accompanying drawings.

DETAILED DESCRIPTION OF THE INVENTION

Figure 1:
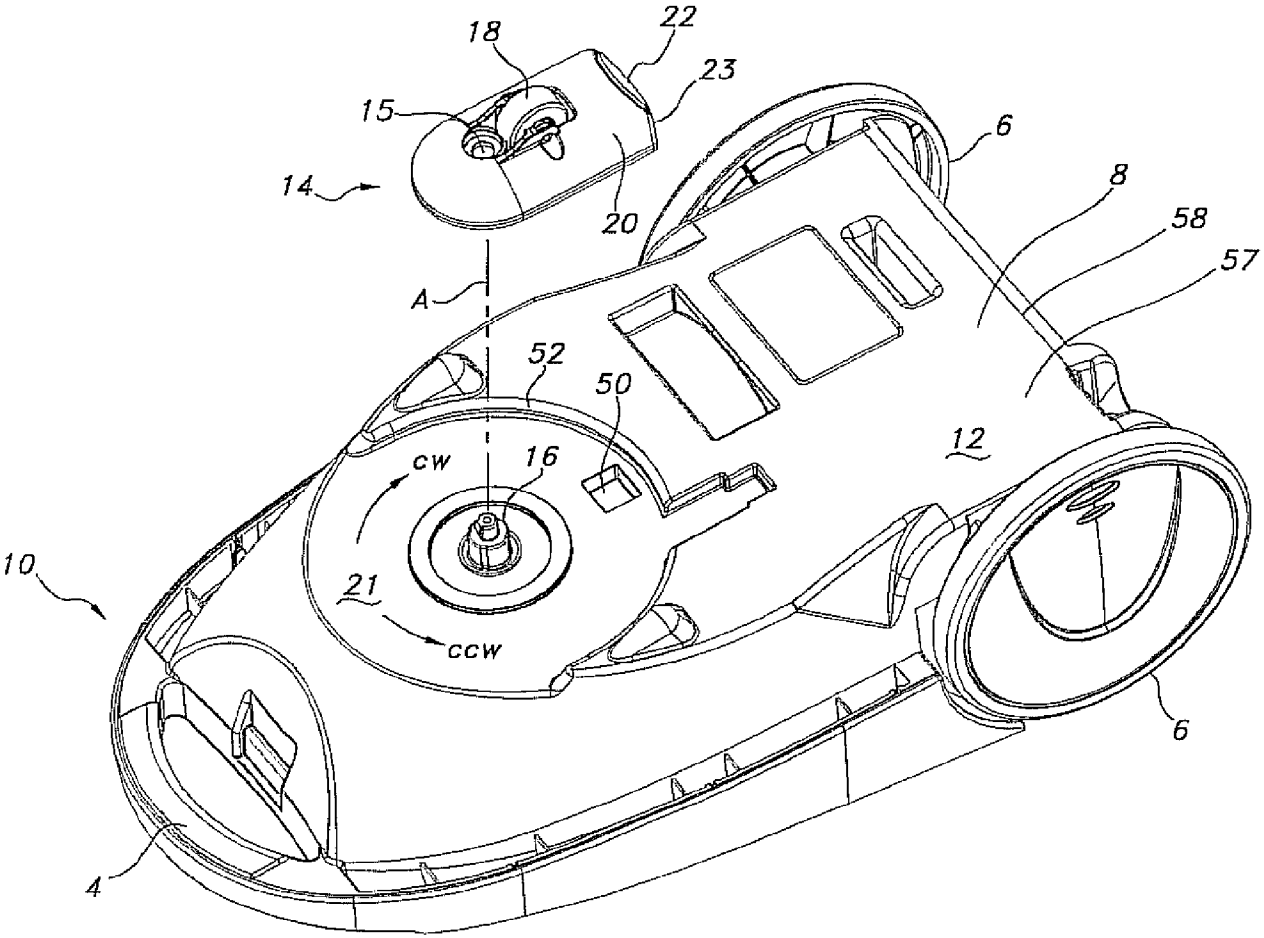
FIG. 1 is a perspective, exploded, view in accordance with the present invention of a canister vacuum cleaner underside equipped with a stair hugging swivel wheel assembly.

With reference to FIG. 1, a canister vacuum cleaner of the present invention is shown as 10. In general, the vacuum cleaner has a canister assembly 8 with rear wheels 6 and an operator handle 4. Within an interior, the canister assembly houses a suction generator in the form of a cooperating fan and motor assembly (not shown) for sucking up dirt and dust and a collection vessel (not shown), such as filter bag, for facilitating the easy collection and discarding of the dirt. In addition, a wand, nozzle and hose interact with canister assembly to facilitate the suctioning of dirt and other debris from carpets or floors as is well known in the art.

On an underside 12 of the vacuum cleaner, a stair hugging swivel wheel assembly 14 mounts thereto. In one embodiment, it mounts by way of an opening 15 that connects to a post 16 of the canister assembly and becomes secured via snap-fitting or other mechanical fasteners. In general, the stair hugging swivel wheel assembly has a wheel 18, especially a caster wheel, rotatably mounted to a housing 20 thereof such that, in combination with the rear wheels 6 of the canister assembly 8, it provides multi-directional wheeled motion to the canister assembly upon a user's actions of pulling or pushing. Specifically, as an operator pulls the canister assembly 8 across a floor, the stair hugging swivel wheel assembly 14 pivots and the wheel 18 functions to guide the canister assembly 8 to follow the operator. In one embodiment, the housing 20 of the stair hugging swivel wheel assembly pivots about an axis A in a circular motion (clockwise CW or counterclockwise CCW depending upon forces applied by the user) about a substantially circular track 21 centered by the post 16.

Figure 2:
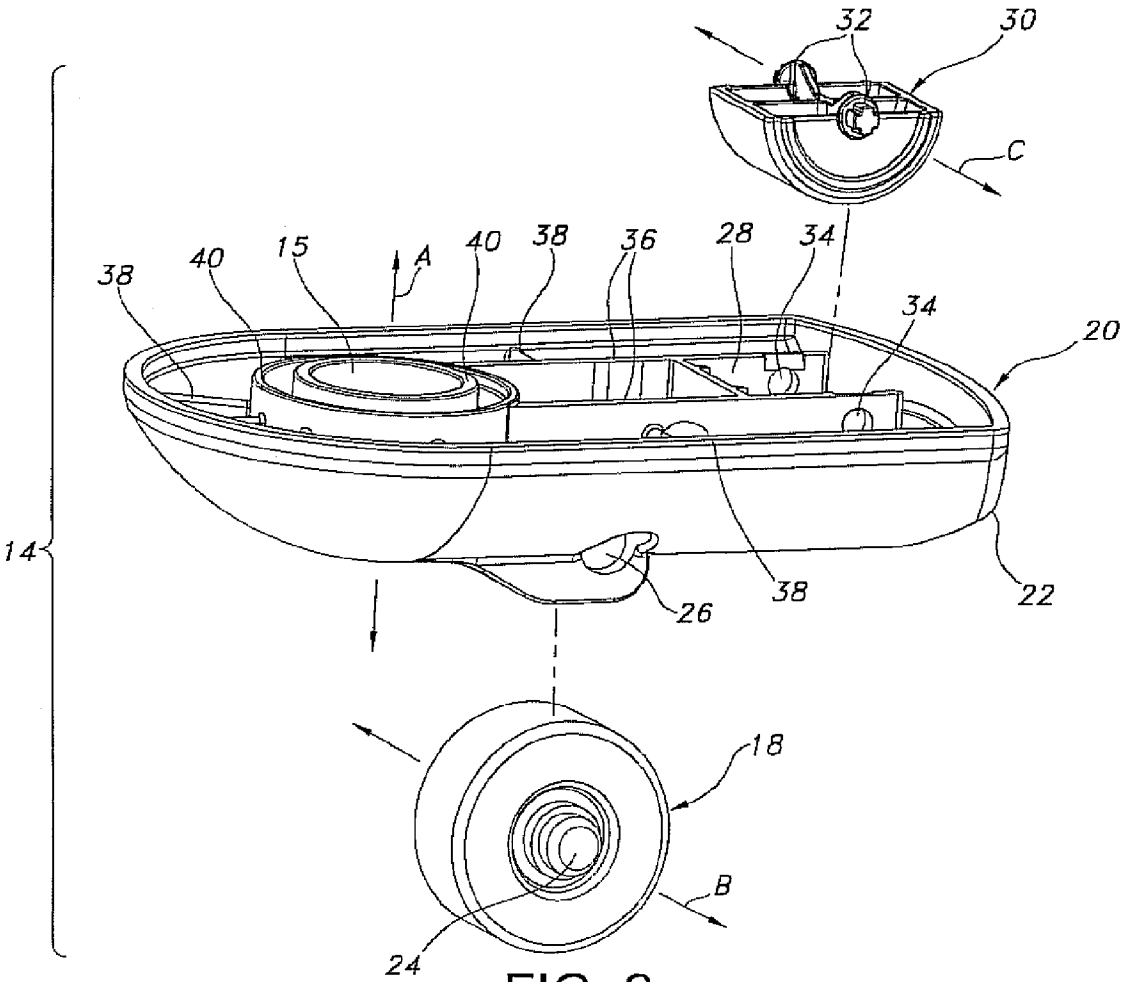
FIG. 2 is an exploded side elevation view of the stair hugging swivel wheel assembly.

With reference to FIG. 2, the wheel 18 mounts to the housing 20 on a stair engaging face 22 side of the stair hugging swivel wheel assembly such that it rotates about an axis B existing substantially perpendicular to the axis A. In various embodiments, the wheel 18 mounts via mechanical arms (not shown) that attach to axial projections 24 on either side of the wheel or mounts by inserting projections 24 into holes 26 defined by the housing. Alternatively, an axle through the wheel (not shown) may serve as a rotation axis.

An interior 28 of the housing mounts a pendulum 30 that freely rotates about an axis C (substantially parallel to axis B) according to the effects of gravity. In one embodiment, the pendulum 30 embodies a truncated cylinder shaped apparatus having projections 32 on either side thereof that mate by insertion into holes 34 defined by walls 36 of the housing. Pluralities of fins 38 project in various ways within the interior to provide structural support for the walls and other components of the stair hugging swivel wheel assembly including concentric walls 40 that define the opening 15 about which the housing pivots.

Figure 3B:
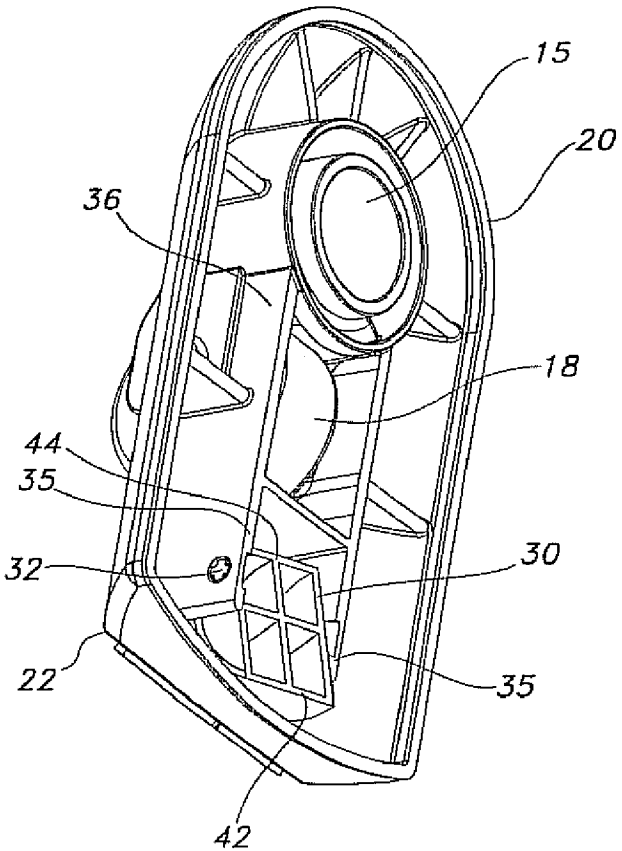
FIG. 3B is a perspective view of the stair hugging swivel wheel assembly shown in FIG. 2 latched or locked in an upright canister operative position.
Figure 3A:
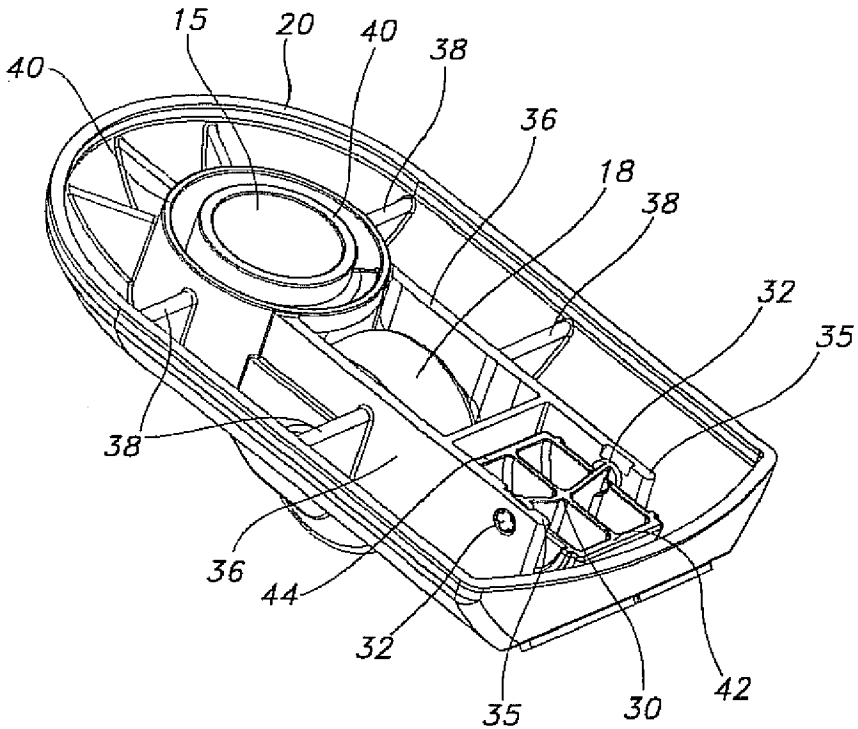
FIG. 3A is a perspective view of the stair hugging swivel wheel assembly shown in FIG. 2 in a horizontal canister operative position.

By comparing FIGS. 3A and 3B, skilled artisans can observe the different positions attainable by the pendulum 30 as the stair hugging swivel wheel assembly, and ultimately the attached canister assembly, changes orientation from a normal, horizontal canister operative position (FIG. 3A) to an upright or vertical canister operative position (FIG. 3B), such as during a stair cleaning operation. Specifically, the pendulum of FIG. 3A embodies a pendulum at rest having its terminal end portions 42, 44 at the same relative vertical distance from tops 35 of the housing walls 36. In contrast, the pendulum 30 of FIG. 3B embodies a pendulum at rest pivoted about its projections 32 such that its terminal end portion 42 projects above tops 35 of walls 36 and projects from the housing 20 in a direction opposite the stair engaging face 22. Meanwhile, the other terminal end portion 44 sinks relative to the tops 35 of the walls 36. In this manner, the terminal end portion may engage or otherwise mate with a recess 50 (referring also to FIG. 1) co-located with the circular track 21 within a boundary 52 thereof. As a result, the stair hugging swivel wheel assembly becomes locked relative to the canister assembly and cannot pivot about its axis A thereby stabilizing the canister assembly.

Appreciating that the stair hugging swivel wheel assembly might not have an orientation in the circular track lending relative alignment between the terminal end portion 42 and the recess 50 to cause instant mating when the canister vacuum cleaner first becomes oriented upright, skilled artisans should appreciate the weight of the wheel 18 creates a moment arm about axis A such that the stair hugging swivel wheel assembly 14 will, under the influence of gravity, pivot about axis A when inclined so that an end 23 of the housing 20 will move clockwise or counterclockwise in a direction toward the recess 50. Thus, eventually, the terminal end portion 42 of the pendulum will slip into the depth of the recess and cause a locked or latched position of the stair hugging swivel wheel assembly. Ultimately, this inhibits or prevents the stair hugging swivel wheel assembly from further pivoting motion thereby allowing effective stabilization of the canister assembly against a stairway or the like. Of course, the stair engaging face 22 may comprise a non-skid, high friction material (indicated as the word Stairgrip or Stairgripper) or include an insert or pad of such material if desired. Additionally, the lower rear end 57 or edge 58 of the canister assembly 8 may also include a stair engaging face with or without an insert or pad of non-skid, high friction material.

Figure 4:
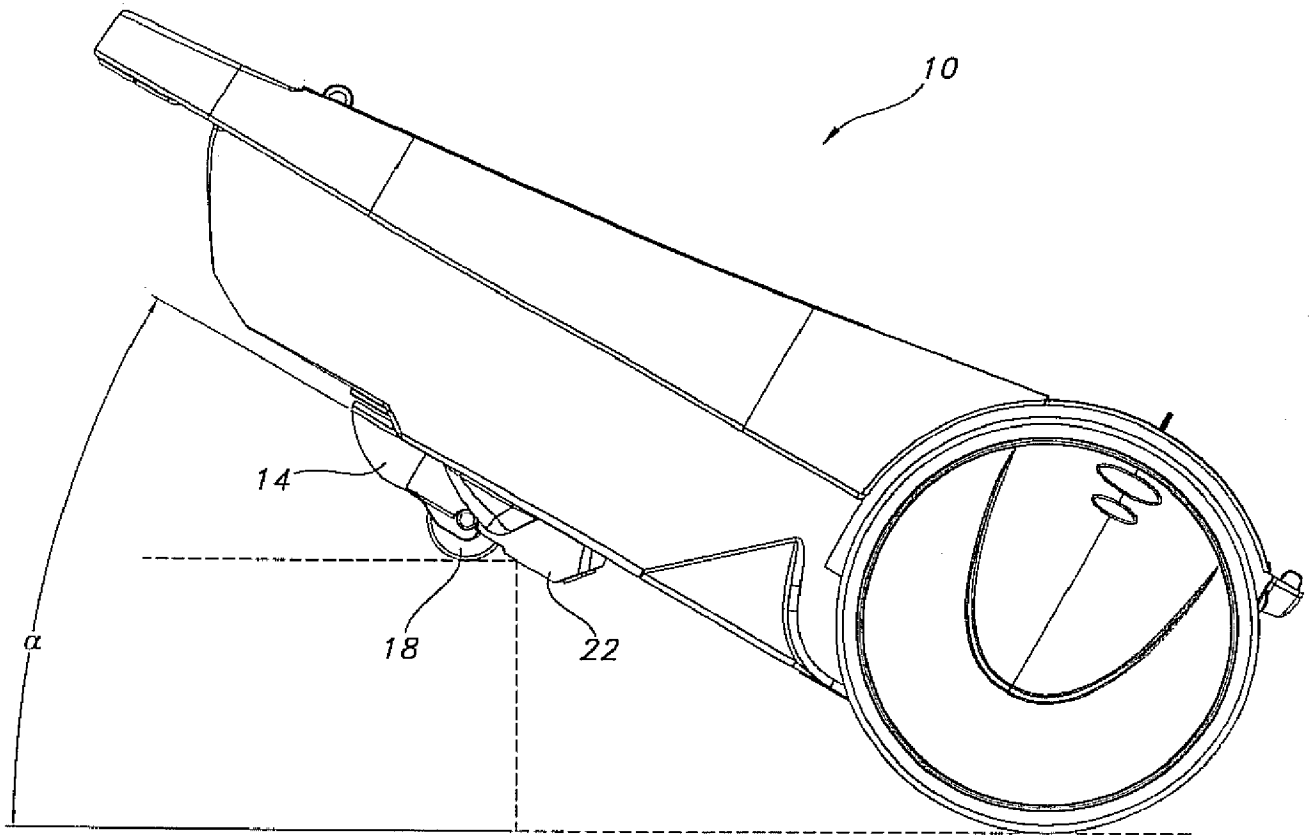
FIG. 4 is a side elevation view showing the manner in which the canister vacuum cleaner of the present invention is stabily supported on a stair by means of the stair hugging swivel wheel assembly when locked in an inclined position.

It should be appreciated that while the canister assembly of FIG. 3B corresponds to an upright or vertical position, the pendulum 30 will exhibit comparable behavior under the influence of gravity whenever the canister assembly becomes oriented in any inclined position beyond the completely upright one shown. Thus, with reference to FIG. 4, an angle a shows a canister vacuum cleaner 10 inclined with respect to a dashed-outline of a stairway. In a preferred range, the angle ranges from about 2° to about 90° or more. More preferably, the angle ranges from about 25° to about 65°.

In summary, numerous benefits result from employing the concepts of the present invention. During normal floor cleaning operation, the stair hugging swivel wheel assembly functions to guide the canister assembly across the floor and follow the operator as the operator uses the hose to pull the vacuum cleaner. In contrast, when the vacuum cleaner becomes tilted or inclined and positioned on a stairway, the stair hugging swivel wheel assembly 14 becomes locked by engagement of the pendulum 30 in the recess 50 of the circular track 21. In this manner, the stair engaging face 22 of the housing 20 becomes properly oriented to stabilize the vacuum cleaner.

The foregoing description of the preferred embodiment of the invention has been presented for purposes of illustration and description. It is not intended to be exhaustive or to limit the invention to the precise form disclosed. Obvious modifications or variations are possible in light of the above teachings.

For example, while the canister vacuum cleaner 10 illustrated herein depicts a stair engaging face 22 on the housing of the stair hugging swivel wheel assembly 14, those skilled in the art should appreciate that it could alternatively embody a component separate and distinct from the stair hugging swivel wheel assembly. Other alternate embodiments include mounting the pendulum and/or caster wheel directly to the canister assembly absent the stair hugging swivel wheel assembly. In addition, the invention contemplates interchangeability while accomplishing the described functions. For example, one or the other of the caster wheel and pendulum may mount on the canister assembly while the other mounts on the stair hugging swivel wheel assembly. Alternatively, the pendulum may mount on the canister assembly while the recess for mating therewith mounts on the stair hugging swivel wheel assembly.

Finally, the embodiments herein were chosen and described to provide the best illustration of the principles of the invention and its practical application to thereby enable one of ordinary skill in the art to utilize the invention and understand variations for accomplishing the same. Accordingly, the claims include all modifications and variations within their scope when interpreted in accordance with the breadth to which they are fairly, legally and equitably entitled. The drawings and preferred embodiments, however, do not and are not intended to limit the ordinary meaning of the claims and their fair and broad interpretation in any way.

The invention claimed is:

1. A canister vacuum cleaner, comprising:

a canister assembly;

a wheel rotatably and pivotally mounted to said canister assembly; and a pendulum connected to said canister assembly for projecting therefrom to inhibit said wheel from pivoting when said canister assembly becomes oriented in an inclined position.

2. The canister vacuum cleaner of claim 1, wherein said wheel mounts to a stair hugging swivel wheel assembly.

3. The canister vacuum cleaner of claim 1, wherein said pendulum mounts to a stair hugging swivel wheel assembly.

4. The canister vacuum cleaner claim 1, further including a stair hugging swivel wheel assembly wherein both said wheel and said pendulum rotatably mount thereto.

5. A canister vacuum cleaner, comprising:

a canister assembly;

a stair hugging swivel wheel assembly pivotally connected to said canister assembly, said stair hugging swivel wheel assembly including a wheel rotatably mounted thereto; and a pendulum connected to one of said canister assembly and said stair hugging swivel wheel assembly for projecting therefrom to inhibit said stair hugging swivel wheel assembly from pivoting when said canister assembly becomes oriented in an inclined position.

6. The canister vacuum cleaner of claim 5, further including a recess on the other of said canister assembly and said stair hugging swivel wheel assembly for mating with said pendulum.

7. The canister vacuum cleaner of claim 5, wherein said pendulum includes a truncated cylinder pivoted about an axis thereof.

8. The canister vacuum cleaner of claim 7, wherein said truncated cylinder has projections on either side thereof that mate by insertion into holes of said one of said canister assembly and said stair hugging swivel wheel assembly.

9. A canister vacuum cleaner, comprising:

a canister assembly; and a stair hugging swivel wheel assembly pivotally connected to said canister assembly, said stair hugging swivel wheel assembly including a housing having a stair engaging face, a wheel rotatably mounted to said housing and a pendulum mounted to said housing for projecting from said housing in a direction opposite said stair engaging face when said canister assembly becomes oriented in an inclined position.

10. The canister vacuum cleaner of claim 9, wherein said pendulum projects from said housing when said canister assembly is tilted at an angle between about 2 to about 90 degrees from a normal, horizontal, operating position of said canister assembly.

11. The canister vacuum cleaner of claim 9, wherein said canister assembly has a recess for mating with said pendulum.

12. The canister vacuum cleaner of claim 11, wherein said recess has a size and shape sufficient for only mating with a terminal end portion of said pendulum.

13. The canister vacuum cleaner of claim 9, wherein said stair hugging swivel wheel assembly pivotally connects to said canister assembly about a first axis and said wheel rotatably mounts to said housing about a second axis, said first and second axises being substantially perpendicular.

14. The canister vacuum cleaner of claim 9, wherein said pendulum mounts to said housing about a first axis and said wheel rotatably mounts to said housing about a second axis, said first and second axises being substantially parallel.

15. The canister vacuum cleaner of claim 9, wherein said stair hugging swivel wheel assembly pivots in a substantially circular track defined on said canister assembly.

16. The canister vacuum cleaner of claim 15, wherein said canister assembly has a recess within a boundary of said substantially circular track for mating with said pendulum.

17. A method for stabilizing a canister vacuum cleaner on a stairway, comprising:

orienting a canister assembly of said vacuum cleaner in an inclined position;

swinging a pendulum, under the influence of gravity, relative to said canister assembly; and engaging said pendulum to prevent pivotal motion of a wheel of said canister assembly relative to said canister assembly.

18. A method for stabilizing a canister vacuum cleaner on a stairway, comprising:

providing a canister assembly of said vacuum cleaner with a stair hugging swivel wheel assembly;

orienting said canister assembly in an inclined position;

swinging a pendulum under the influence of gravity from said stair hugging swivel wheel assembly;

pivoting said stair hugging swivel wheel assembly under the influence of gravity; and engaging said pendulum with said canister assembly.

19. The method of claim 18, wherein said swinging said pendulum further includes pivoting a truncated cylinder apparatus about a plurality of projections on either side thereof.

20. The method of claim 18, wherein said engaging said pendulum further includes mating a terminal end portion of said pendulum in a recess of said canister assembly.

* * * * *

UNITED STATES PATENT AND TRADEMARK OFFICE

CERTIFICATE OF CORRECTION

PATENT NO. : 7,281,295 B2
APPLICATION NO. : 10/876151
DATED : October 16, 2007
INVENTOR(S) : Mattingly et al.

It is certified that error appears in the above-identified patent and that said Letters Patent is hereby corrected as shown below:

Title Page Should Read

(73) Assignee: Panasonic Corporation of North America, Secaucus, NJ (US)

Signed and Sealed this

Eighth Day of April, 2008

JON W. DUDAS
*Director of the United States Patent and Trademark Office*